US005771943A

United States Patent [19]

Carlson

[11] Patent Number: 5,771,943

[45] Date of Patent: Jun. 30, 1998

[54] METHOD AND APPARATUS FOR THE MANUFACTURE OF CARPET INCLUDING AN ADDITIONAL WEFT MATERIAL

[75] Inventor: Brian Carlson, Howick, New Zealand

[73] Assignee: Duralite Carpet Corporation Limited, Howick, New Zealand

[21] Appl. No.: 464,648

[22] PCT Filed: Dec. 21, 1993

[86] PCT No.: PCT/NZ93/00129

§ 371 Date: Jun. 21, 1995

§ 102(e) Date: Jun. 21, 1995

[87] PCT Pub. No.: WO94/15009

PCT Pub. Date: Jul. 7, 1994

[30] Foreign Application Priority Data

Dec. 21, 1992 [NZ] New Zealand ..... 245551

[51] Int. Cl.[6] ..... D03D 27/06; D03D 27/02

[52] U.S. Cl. ..... 139/406; 139/403; 139/39; 139/391; 139/394

[58] Field of Search ..... 139/398, 402, 139/403, 404, 405, 406, 39, 391, 21, 397, 2–5, 383 A, 394, 20

[56] References Cited

U.S. PATENT DOCUMENTS

| | | | |
|---|---|---|---|
| 431,844 | 7/1890 | Heald | 139/394 |
| 1,394,869 | 10/1921 | Stroud, Jr. | 139/394 |
| 1,914,278 | 6/1933 | Mostertz | 139/403 |
| 2,720,222 | 10/1955 | Hoeselbarth . | |
| 2,759,495 | 8/1956 | Masland . | |
| 2,898,947 | 8/1959 | Hoeselbarth . | |
| 3,499,471 | 3/1970 | Kuny | 139/21 |
| 3,818,951 | 6/1974 | Greenwood | 139/20 |
| 4,456,035 | 6/1984 | Brüggemann et al. | 139/21 |
| 4,848,413 | 7/1989 | Gray | 139/397 |
| 5,164,249 | 11/1992 | Tyler et al. | 139/383 A |
| 5,465,761 | 11/1995 | Gheysen | 139/398 |

FOREIGN PATENT DOCUMENTS

| | | | |
|---|---|---|---|
| 1192849 | 8/1989 | Japan | 139/402 |

OTHER PUBLICATIONS

Patent Abstract of Japan, C988, p. 54, JP,A, 4–163341, (Takemitsu Kawaguchi) 8 Jun. 1992 (Aug 6, 1992).

*Primary Examiner*—Andy Falik

*Attorney, Agent, or Firm*—Merchant, Gould, Smith, Edell, Welter & Schmidt, P.A.

[57] ABSTRACT

A carpet includes a weft fill material (18*c*) which fills the loops formed in the pile of warp yarns (14*a* and 14*b*) so as to be partially visible to contribute to both the design and appearance of the resultant carpet and the durability by supporting the inside of the loops formed by the warp yarns (14*a* and 14*b*). The binding chains (17*a* and 17*b*), with the wefts (18*a* and 18*b*), bind the pile warp yarns (14*a* and 14*b*) to the carpet backing with the stuffer (16) being held securely between the wefts (18*a* and 18*b*) . In alternative embodiments the binding chains (17*a* and 17*b*) can be partially or totally omitted with the warp yarns (14*a* and 14*b*) being fed over and under the stuffer (16). Apparatus for forming the carpet is described.

10 Claims, 10 Drawing Sheets

METHOD AND APPARATUS FOR THE MANUFACTURE OF CARPET INCLUDING AN ADDITIONAL WEFT MATERIAL

BACKGROUND OF THE INVENTION

The present invention relates to improvements in and relating to a method and apparatus for the manufacture of carpet and to a carpet manufactured thereby. To the present time various types of carpet such as Wilton can be manufactured by various techniques in producing a commercially acceptable product.

The term "carpet" is used throughout this specification to cover all types of woven surface covering.

Presently available techniques for making woven carpet suffer from various disadvantages including the complexity of the looms. The Wilton wire loom requires for example a multiplicity of pile wires to be inserted and withdrawn leaving the pile as a hollow loop or is cut open by a bladed wire. These hollow loops also have the drawback of contributing to the flammability of the carpet in providing a source of oxygen for any flame within the pile. Existing production techniques may also tend to suffer from a certain lack of flexibility in allowing ease of change of carpet patterns.

It is thus an object of the present invention to provide an improved method and/or apparatus for the manufacture of carpet and/or an improved carpet, overcoming or at least obviating the disadvantages in methods, apparatus and/or carpets available to the present time or to at least provide the public with a useful choice.

Further objects of the invention will become apparent from the following description.

BRIEF SUMMARY OF THE INVENTION

According to one aspect of the present invention, there is provided a method for the production of carpet comprising weaving together warp material including pile warp material, first and second weft materials and an additional weft material such that the additional weft material is held by and partially visible through the pile warp material and contributes to the pile of the carpet, and said first, second and additional weft materials are woven in simultaneously.

According to a further aspect of the present invention, there is provided an apparatus for producing carpet comprising feeding means for feeding first and second weft material and warp material including pile warp material to a weaving means for their weaving together and wherein said feeding means includes means for feeding an additional weft material to said weaving means for weaving together with the warp material, said additional weft material to be held by and to be partially visible through the pile warp material and contributing to the pile of the carpet, and said feeding means feed the first, second and additional weft materials simultaneously.

According to a still further aspect of the present invention, there is provided a carpet comprising first and second weft material and warp material including pile warp material woven together with an additional weft material held by and partially visible through the pile warp material and that contributes to the pile of the carpet.

DESCRIPTION OF PREFERRED EMBODIMENTS OF THE INVENTION

In the understanding of the invention the following is a glossary of the terms which have been used with their intended meanings:

Flammability—The extent to which a material is flammable.

Rapier—A metal rod which carries weft material and inserts a length into the open sheds which is then cut.

Dent—A space between two vertical wires in the reed, similar to a comb.

Warp—Yarn material used for the backing or pile and running in a linear direction.

Weft—Yarn material running in a transverse direction.

Shed—The intermittent space created between the yarn materials during the weaving cycle to allow insertion of the rapiers carrying weft yarns.

Wire—A metal wire strip typically 0.200" high by 0.05" thick, used to form pile loops, which may remain hollow or may be cut open, in weaving Wilton pile products.

Beat up arm—The mechanism carrying the reed which "beats" the materials together tightly.

Weft fill—The additional weft material contributing to the pile and provided by the present invention.

Heald wire—A wire with an eye approximately half way up its vertical length.

Breast plate—A flat plate supporting the point of weave.

Point of weave—The focus of all the warp and weft materials, the point where individual materials become the carpet.

Yarn—One or more synthetic or natural filaments or fibres, including several twisted together.

Pile—The generally vertical material above the backing.

Backing—The structure providing stability and a base for the pile.

Binding chain—warp yarn woven in a chain like manner to link all components tightly together.

Stuffer—Warp yarn laying straight in the backing, woven under heavy load and providing linear stability and strength.

Weft presenter—The mechanism which presents the wefts for pick up by the rapiers.

Shot—A single insertion of weft.

Beam—Metal "bobbin" type holder for the backing material.

Cheese—Material wound on a tube (a tube is a bobbin without flanges).

Dobby—A mechanism for activating warp yarn materials in groups to give simple designs and visual effects.

Jacquard—A mechanism for activating individual warp yarn materials in any programmed sequence to give more-complex designs and visual effects.

Creel—A frame holding hundreds of "cheeses" of pile yarn material.

Partially visible—Alternating between visible and non-visible.

Figure 1A:
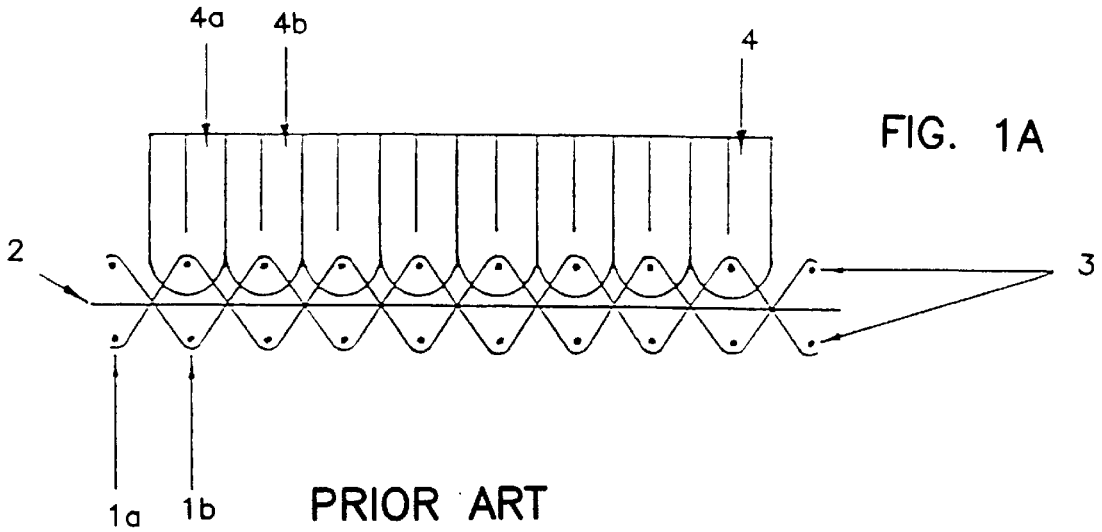
FIG. 1A PRIOR ART
FIGS. 1A, 1B and 1C: Show very diagrammatically examples of "prior art" carpet manufacture.
Figure 1B:
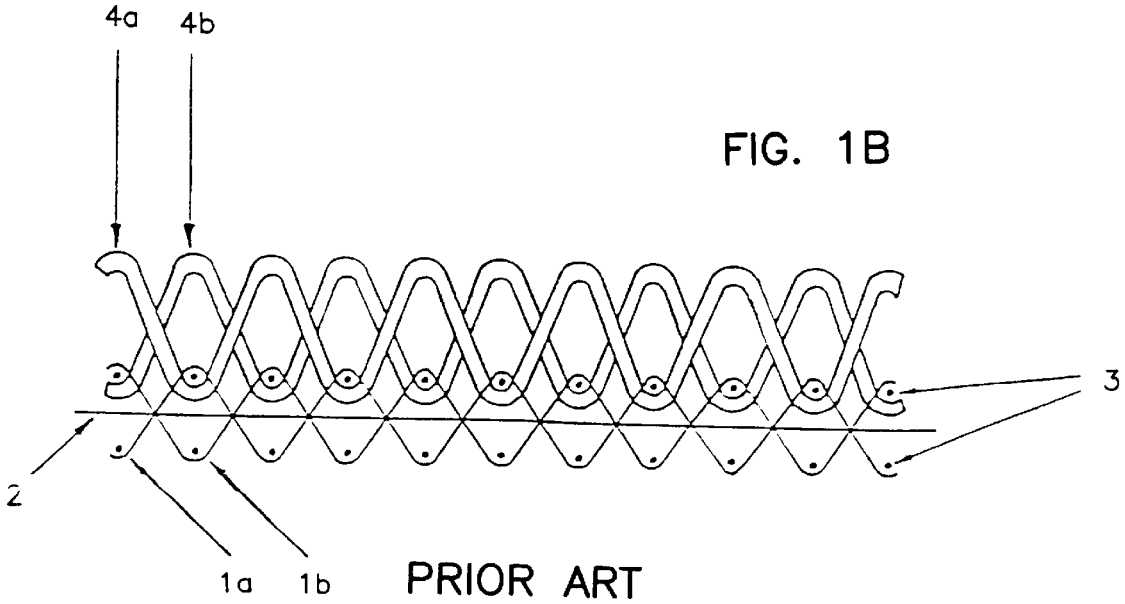
FIG. 1B PRIOR ART
Figure 1C:
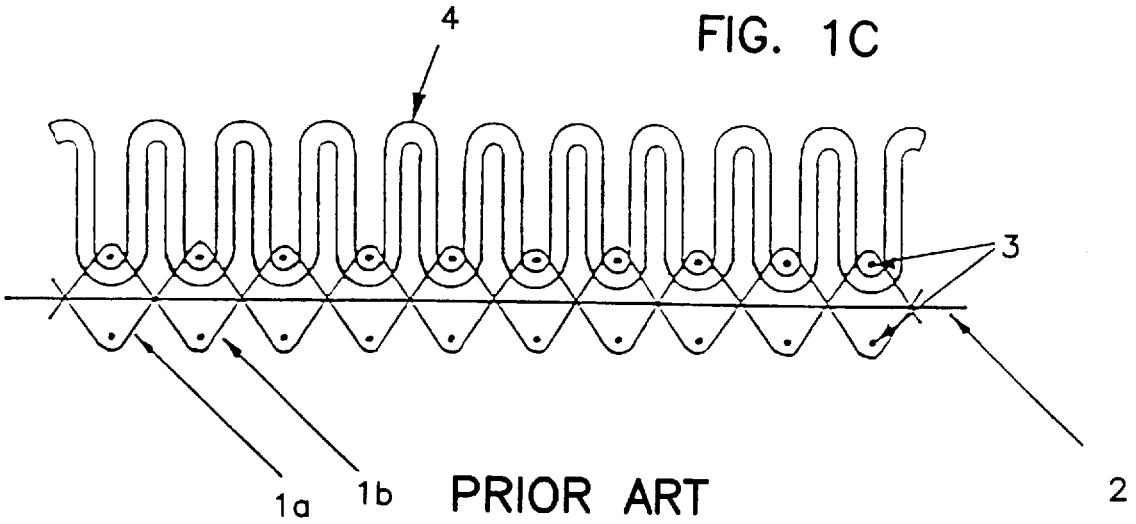
FIG. 1C PRIOR ART

Referring firstly to FIGS. 1A, 1B and 1C, these show very diagrammatically examples of prior art carpet structures.

The very diagrammatic cross-sectional view in FIG. 1A shows binding chains 1*a* and 1*b* forming a chain of links which, with wefts 3, bind the pile warp yarn 4 to the backing. The stuffer 2 lies straight in the center of the backing. The binding chains 1*a* and 1*b* alternately connect with wefts 3, which in turn bind pile warp yarns 4*a*, 4*b*.

In FIG. 1B, the binding chains 1*a* and 1*b* and the wefts 3, bind the pile warp yarns 4*a* and 4*b* alternately to the backing. Once again the stuffer 2 lies straight in the center of the backing. The carpet of FIG. 1B is a Wilton type carpet with the hollow loops of the pile warp yarns 4*a* and 4*b* being formed by pile wires which are sequentially inserted and withdrawn during the carpet manufacture.

In FIG. 1C, the binding chains 1*a* and 1*b* and the wefts 3, bind the pile warp yarn 4 to the backing. The stuffer 2 lies straight in the linear direction through the center of the backing. The carpet of FIG. 1C is a Wilton type carpet with hollow loops of pile warp 4 being formed by pile wires which are sequentially inserted and withdrawn during the carpet manufacture.

The term "Wilton" generally refers to a loop pile or cut pile carpet but due to the versatility of the Wilton loom, the term can be regarded as a generic term covering many styles of products such as those shown in FIGS. 1A, 1B and 1C.

In the Wilton wire loom, the backing materials are brought together to make the backing for the pile material, in the traditional weaving method of combining warp and weft materials.

Concurrently with the production of the backing the pile is formed by inserting a succession of metal wires under the pile yarn material which is raised to a higher plane than the backing materials to accommodate the wires.

As weaving proceeds, the first wire (the wire nearest the operator) from a set of say 30 such wires is withdrawn to leave a row of hollow loops above the backing of the carpet. These wires are withdrawn and inserted in a sequential manner providing a constant supply of wires. The cycle of all necessary actions in the formation of each row of loops across the width of the product requires two, and in some cases more, revolutions of the crankshaft central to the loom function.

The complexity of the Wilton loom with its requirement to sequence the insertion and withdrawal of a multiplicity of long wires has inevitably resulted in a relatively slow process time.

In contrast, the present invention does away with the use of such wires and permits a single cycle operation as opposed to a multi-cycle operation to further speed up the production rate and in doing so achieves a carpet which has inherent advantages over previous types of carpet produced such as by the Wilton loom.

It is useful to refer in greater detail to the Wilton wire loom. This type of loom generally weaves a two shot construction. By its very nature, each shot must be inserted separately, the back shot simultaneously with the wire insertion and the second shot coinciding with the wires withdrawal, binding the pile yarn just used over the wire to the backing of the carpet.

The shedding provides open sheds as appropriate to accept both the shots of weft and the wire but the two shots and the wire cannot be accommodated simultaneously.

This situation results in a slow production rate, for example, a typical Wilton wire loom of 1.5 meters width would weave at a rate of about 70–75 picks or shots per minute. Each row of loops requires two shots, so that weaving a carpet of a linear density of 315 rows per meter, the Wilton loom will produce, at 100% efficiency 75×60=4500 picks % 630=7.14 lineal meters per hour. The present invention in one embodiment however in trials, weaving 1.5 meter width carpet, has run at 73 insertions/minute=73×60=4380 picks. However, each insertion creates one row of loops so this total is only divided by 315=13.9 lineal meters per hour. It is anticipated that the increased production rate will apply in comparison to any width of loom.

A loom according to one possible embodiment of the present invention can provide open sheds to accommodate all three weft components, the top shot, the bottom shot and the weft fill instead of the wire and hence the completion of each row every cycle rather than the need for two cycles as in the Wilton wire loom mentioned above.

The 100% efficiency mentioned above is of course never achieved. A Wilton wire loom could normally be expected to run at approximately 65–70% efficiency. It is envisaged that because of the simplified design of a loom according to the present invention with its lesser number of parts and the lack of the complex wire insertion/withdrawal mechanism which can account for much of the total down time of the Wilton loom, an efficiency of perhaps 70–80% for the present invention is believed to be feasible.

Figure 2A:
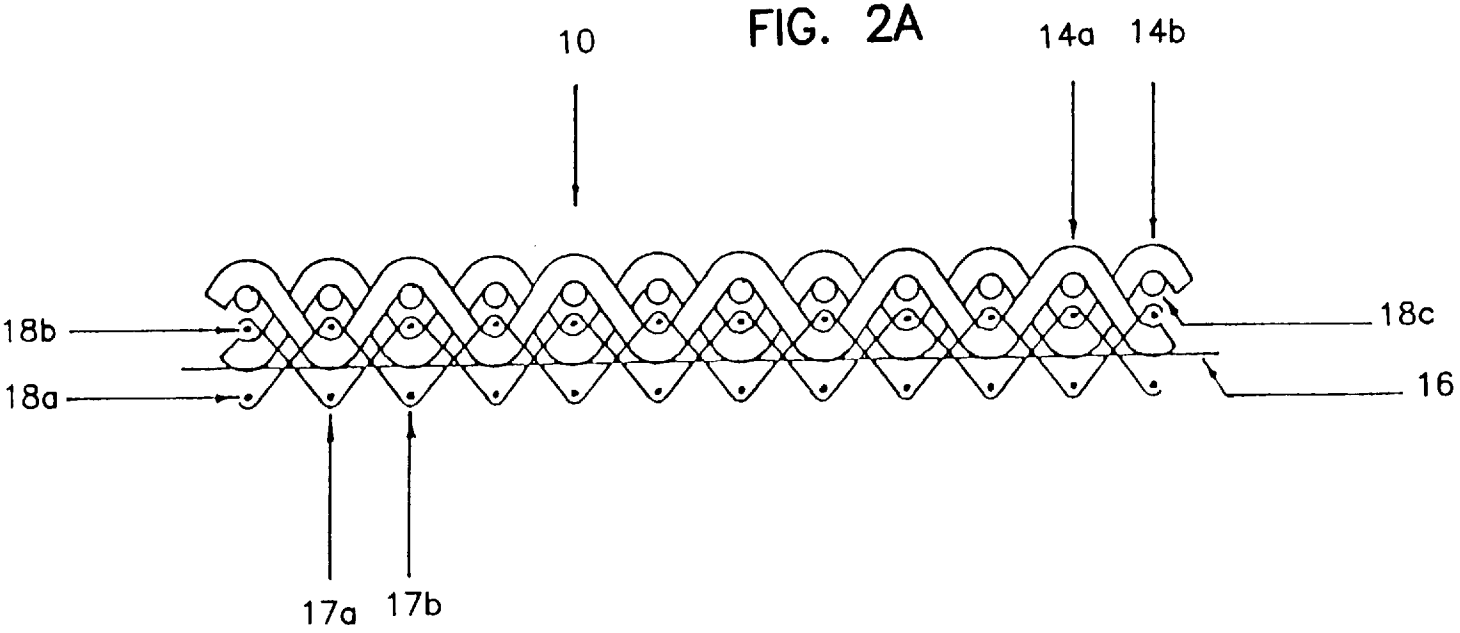
FIGS. 2A and 2B and 2C: Show very diagrammatically cross-sectional and perspective views of carpet according to one possible embodiment of the present invention.

Referring to FIGS. 2A and 23, a carpet according to one possible embodiment of the invention is referenced generally by arrow 10 and is shown very diagrammatically in cross-sectional and perspective views. FIGS. 2A or 23 show a group of warp yarns contained in one dent of which there may be typically 270–360 per meter across the width of the product although a wider range is possible typically from at least 120, with bulkier yarns to 480 or more with finer yarns.

In FIGS. 2A and 2E, binding chains 17*a* and 17*b* form a chain of links which with wefts 18*a* and 18*b* bind the pile warp yarns 14*a* and 14*b* to the backing, the stuffer 16 being held securely between wefts 18*a* and 18*b*. It is seen however that an additional weft material 18*c* is provided to fill the loops formed in the pile of warp yarns 14*a* and 14*b*. This "weft fill" 18*c* will therefore be partially visible through the pile warp material and so will contribute to the design and appearance of the resultant carpet. It has been found that just from two or three specified shades, several pile yarns 14*a* and 14*b* and weft fill 18*c* can be assembled, using solids and stipples, and these can be woven to give many permutations of different color and effect combinations because of the contribution to the design and appearance by the weft fill 18*c*. In FIG. 2C the additional weft material 18*c* can be seen partially visible among the warp yarns 14*a* and 14*b*.

Various other advantages may, the applicant believes, be achievable from the introduction of the weft fill 18*c*, including:

i) An improved appearance retention;

ii) A increased durability for the same weight and/or reduced weight for the same durability;

iii) An improved resistance to flammability;

iv) An improved resistance to fibre loss;

v) Base of cleaning;

vi) Resistance to staining;

vii) Less weight of carpet resulting in easier handling and installation; and viii) Reduced friction to devices moving over the carpet.

On the flammability aspect, it will be appreciated that in a typical Wilton product as described previously in respect of FIG. 1, the hollows provided within the pile loops are believed by the applicant to provide a source of oxygen which will sustain any flame present in or on the carpet. In contrast the weft fill 18*c* is taking up what otherwise would be an oxygen containing space and must therefore reduce the amount of oxygen available for feeding any flame. The weft fill 18*c* is also providing an intermediate layer to support and absorb pressures imposed on the warp yarns 14*a* and 14*b* so as, it is believed, to improve durability and appearance retention as mentioned above.

Figure 2B:
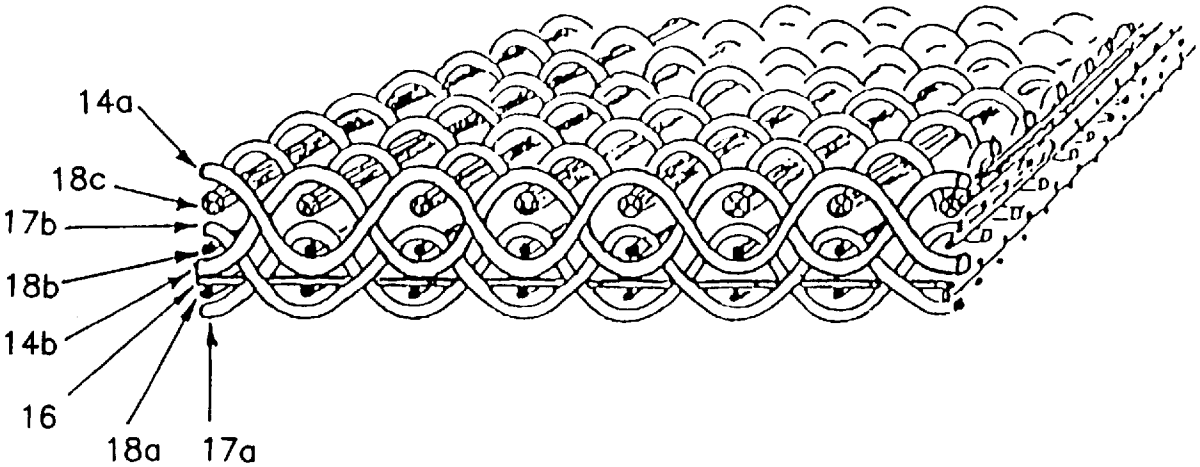
Figure 2C:
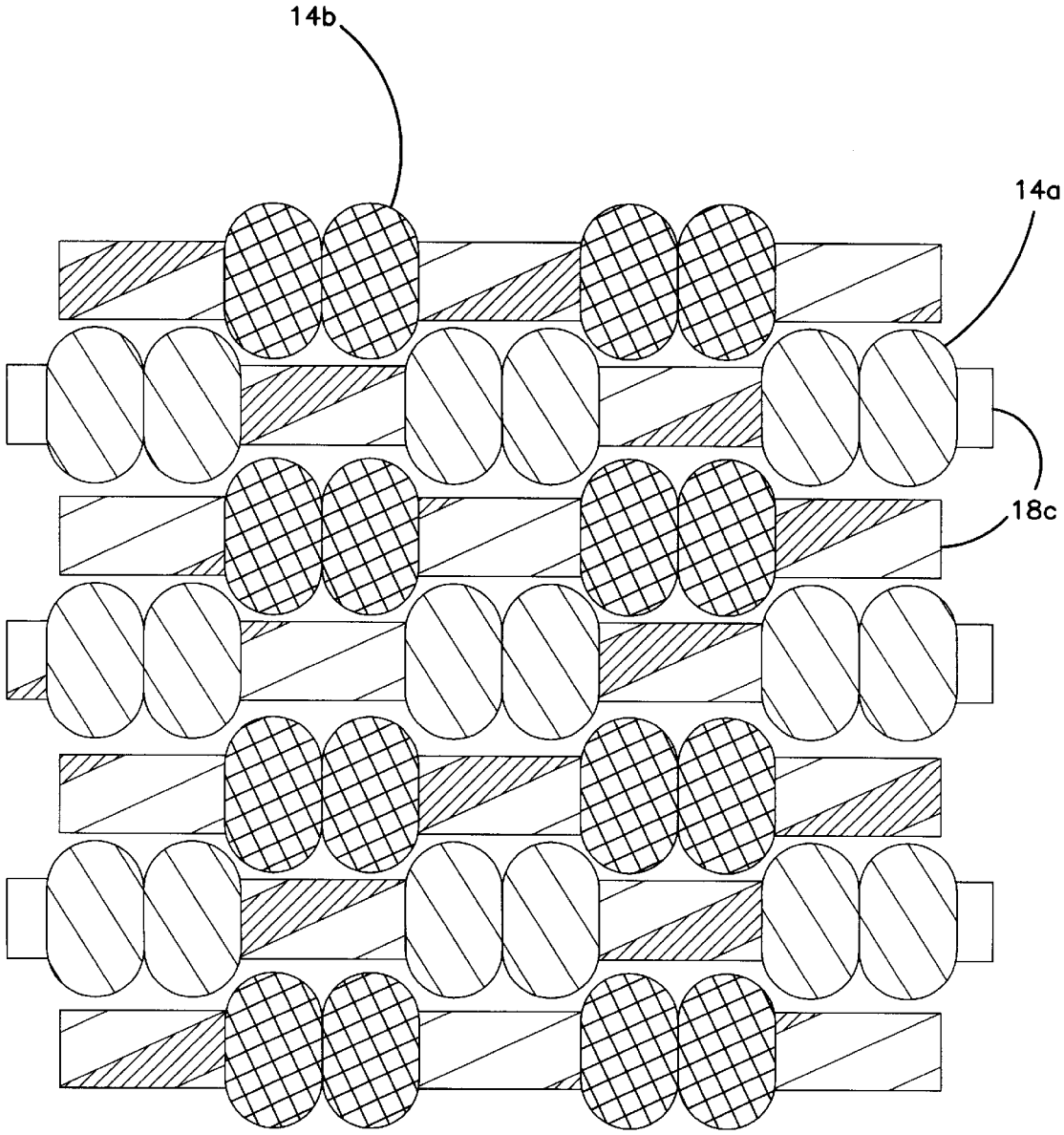

Alternative embodiments of the invention may provide different carpet structures to that shown in FIGS. 2A and 2B. For example the pile yarn material 14*a* and 14*b* may be fed over and under the stuffer 16 in eliminating the use of the binding chains 17*a* and 17*b* relying on friction to hold the structure together and prior to a backing coating being applied. The production of such a structure is described hereinafter in respect of FIG. 6.

Any suitable materials could be used for the carpet of the present invention. For example the backing materials may be polyester and glass fibre or polypropylene with the pile warp and weft fill being woollen yarns. Alternative materials and alternative techniques of weaving same will be readily apparent to those skilled in the carpet making art.

Figure 3:
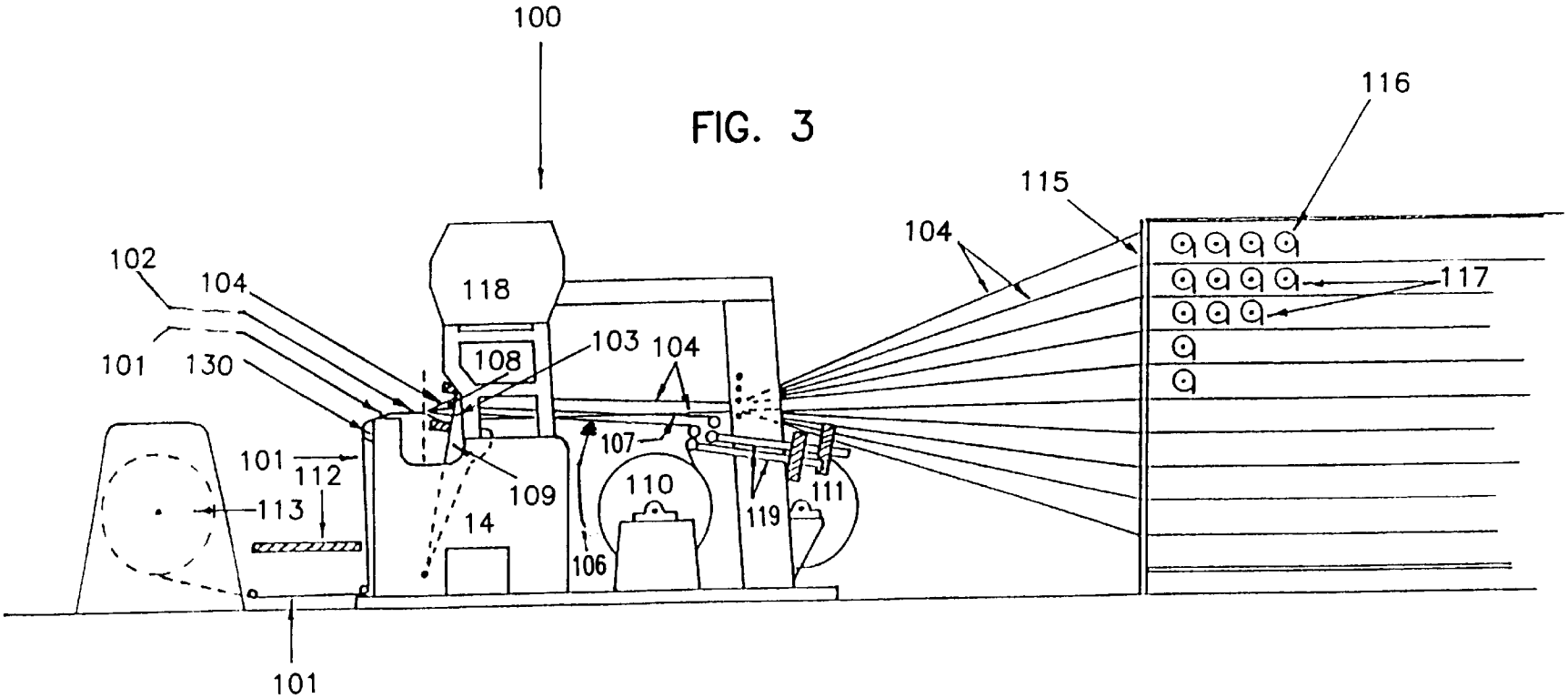
FIG. 3: Shows very diagrammatically a side perspective view of a carpet loom according to one possible embodiment of the invention.
Figure 4:
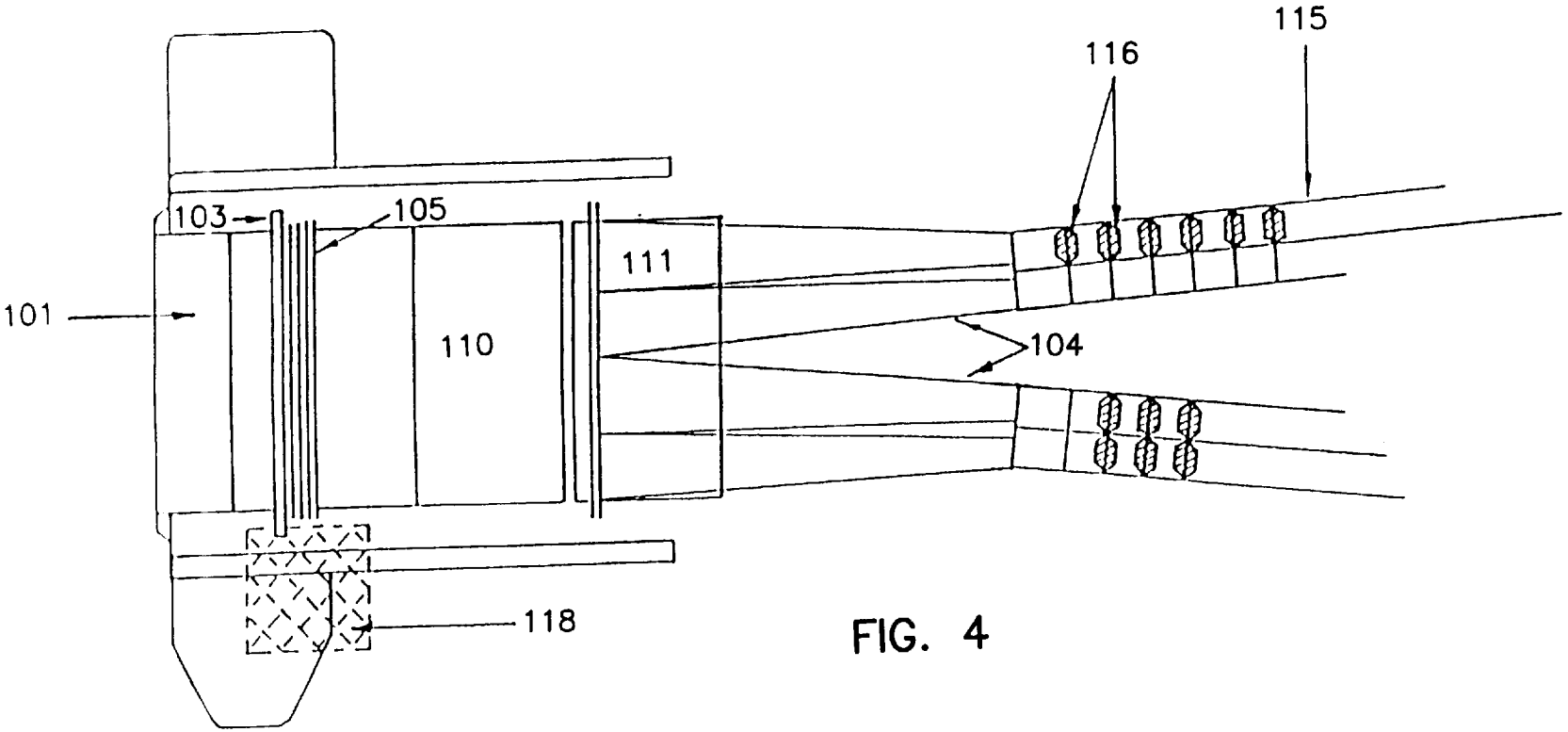
FIG. 4: Shows very diagrammatically a plan view of the loom of FIG. 3.
Figure 5:
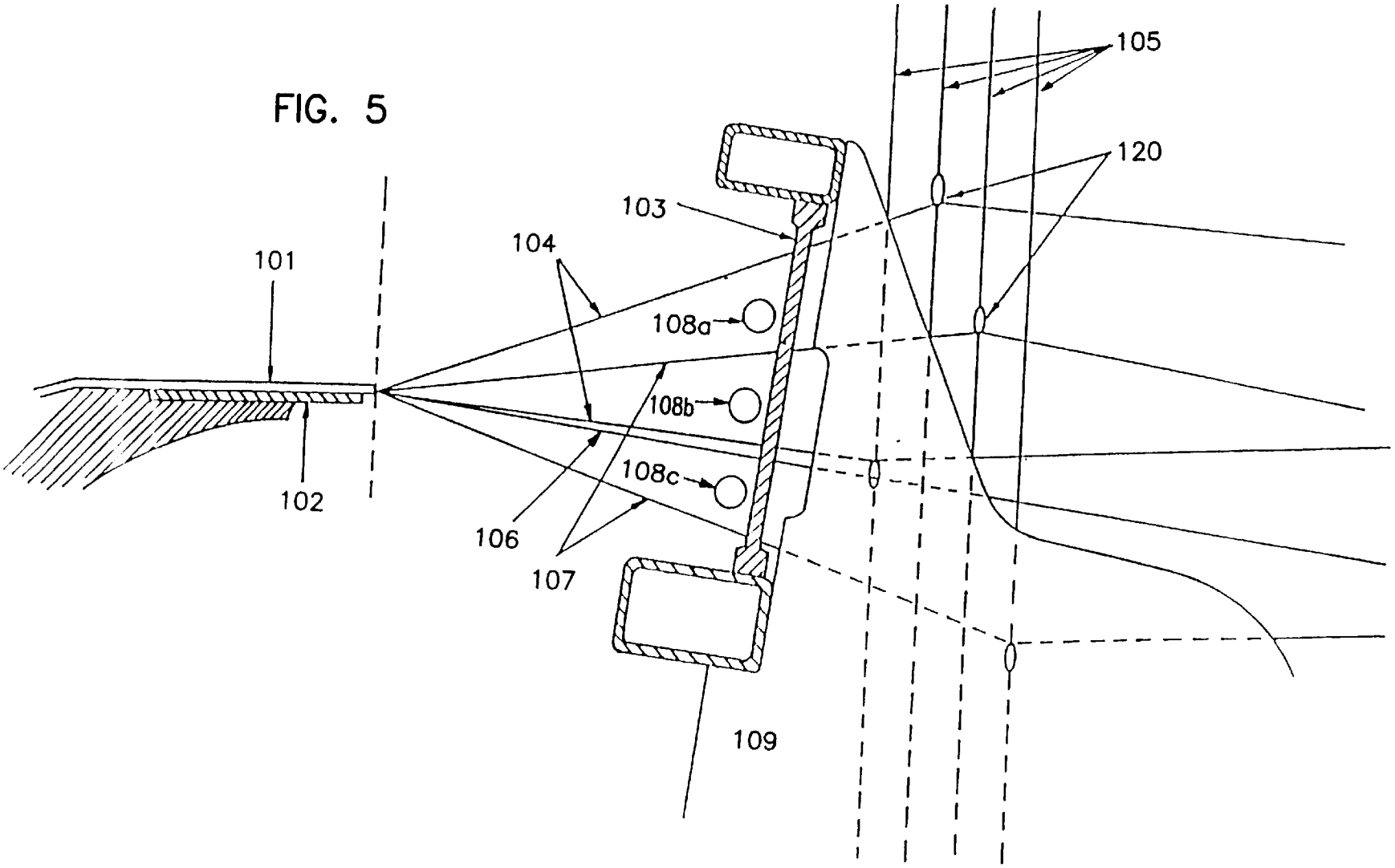
FIG. 5: Shows very diagrammatically shedding detail of the loom of FIGS. 3 and 4.

Referring now to FIGS. 3 to 5, a loom according to one embodiment of the present invention is referenced generally by arrow 100 and shows very diagrammatically the woven product 101 being produced to be fed on to a roll 113. A platform 112 is shown provided for an operator of the machine. The loom 100 is shown having a breast plate 102 being fed by a reed 103 with the pile yarn 104, stuffer yarn 106 and binding chain yarn 107. The breast roller 130 pulls the warp material and the woven carpet through the loom at a preset rate relevant to the linear density of the carpet. Rapiers 108 act in feeding the weft material into the open sheds. The beat up arm 109 carries the reed 103 to beat the materials together tightly.

118 shows the heald drive operating the heald wires 105 (see FIG. 4).

In FIG. 5 the sheds (spaces) are shown open so that the rapiers 108*b* and 108*c* carrying the weft and 108*a* carrying the weft fill can be inserted simultaneously. The stuffer warp 106 remains stationary throughout the weaving cycle.

During the weaving cycle, binding chain warps 107 exchange positions with each other at the same time as the pile yarns 104 exchange positions with each other. The binding chain warps 107 and the pile yarns 104 are driven up and down by the heald wires 105. Each of the heald wires 105 is shown provided with an eye 120 through which binding chain warp 107 and pile yarns 104 can pass. While four heald wires 105 are shown in FIG. 5, it is envisaged that additional or less heald wires could be used in alternative embodiments. The heald wires 105 connect to a cam disc arrangement or Dobby to control the required patterning. Connecting the heald wires 105 to a Jacquard will allow for more detailed patterns to be produced.

Figure 6:
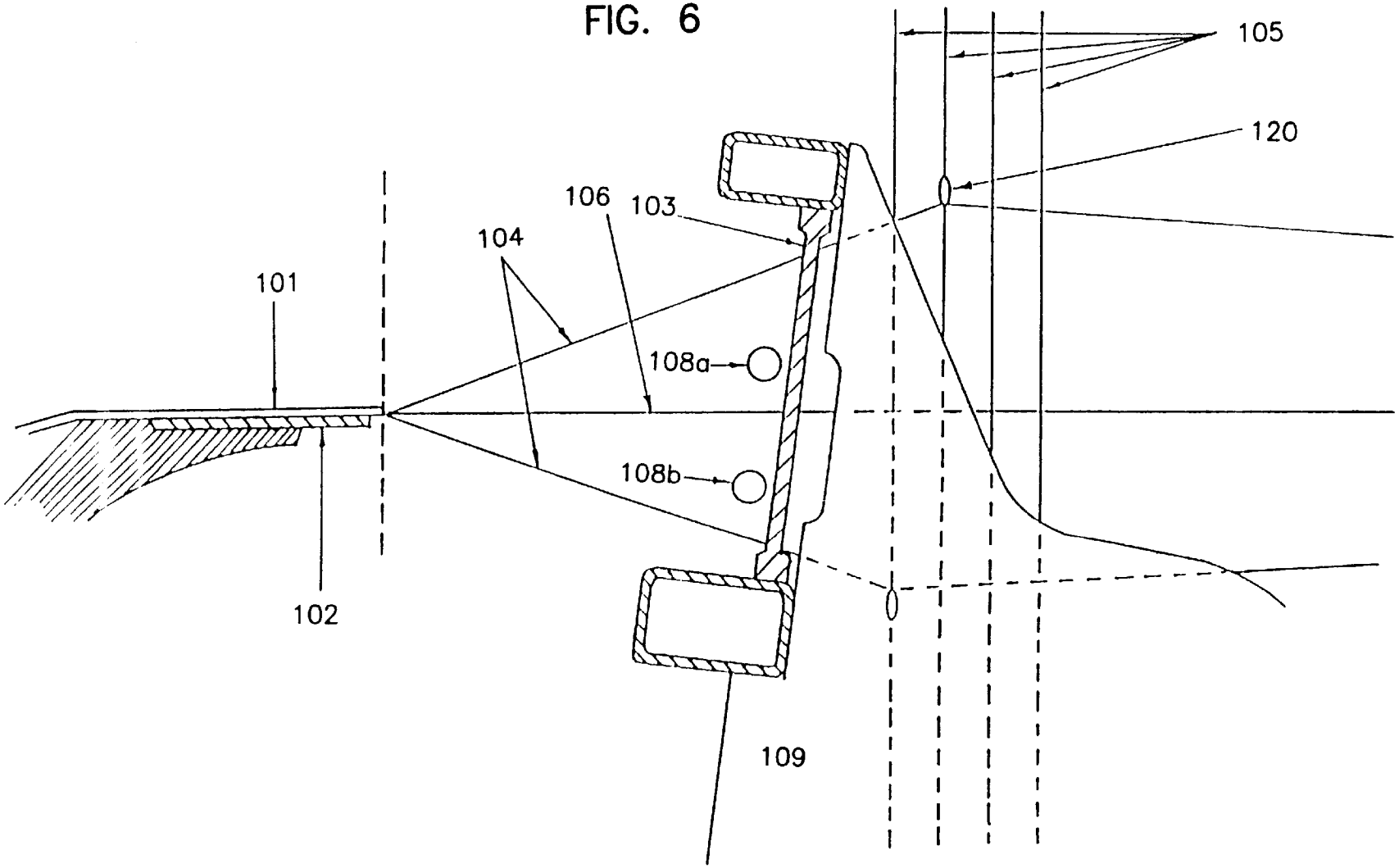
FIG. 6: Shows an alternative shedding detail according to a further embodiment of the invention.

In use, beat up arm 109 carrying reed 103 is driven forward to a point just short of the leading edge of the breast plate 102 as shown in FIGS. 5 and 6. This is the point of weave where the warps 104 and 107 are approximately half way through their vertical movement and are more or less in a horizontal line together with warp 106 extended from the breast plate 102. The reed 103 beats up the three wefts previously inserted by the rapiers 108*a*, 108*b* and 108*c* into the carpet and the exchange of all the warp positions is then completed immediately following this in readiness for the next weaving cycle.

FIGS. 3 and 4 show generally the positioning of the pile yarn cheeses 116, the stuffer beam 110, the binding chains beam 111 and the tension weights 119. The pile yarn cheeses 116 are shown provided on a creel frame 115, with respective creel weights 117.

Returning to the enlarged diagrammatic view shown in FIG. 5, it is seen that three rapiers 108 are used, rapiers 108*b* and lose for carrying two wefts and top rapier 108*a* for carrying the weft fill (18*c* in FIGS. 2A and 23).

In an alternative embodiment shown in FIG. 6, it is seen that only one rapier 108*a* for the weft fill and one rapier 108*b* for the weft, are shown provided. Also, the binding chain warp yarn 107 is absent in this embodiment and instead the yarn pile 104 is being fed over and under the stuffer warp yarn 106 to combine with the weft fill and weft material.

Figure 7:
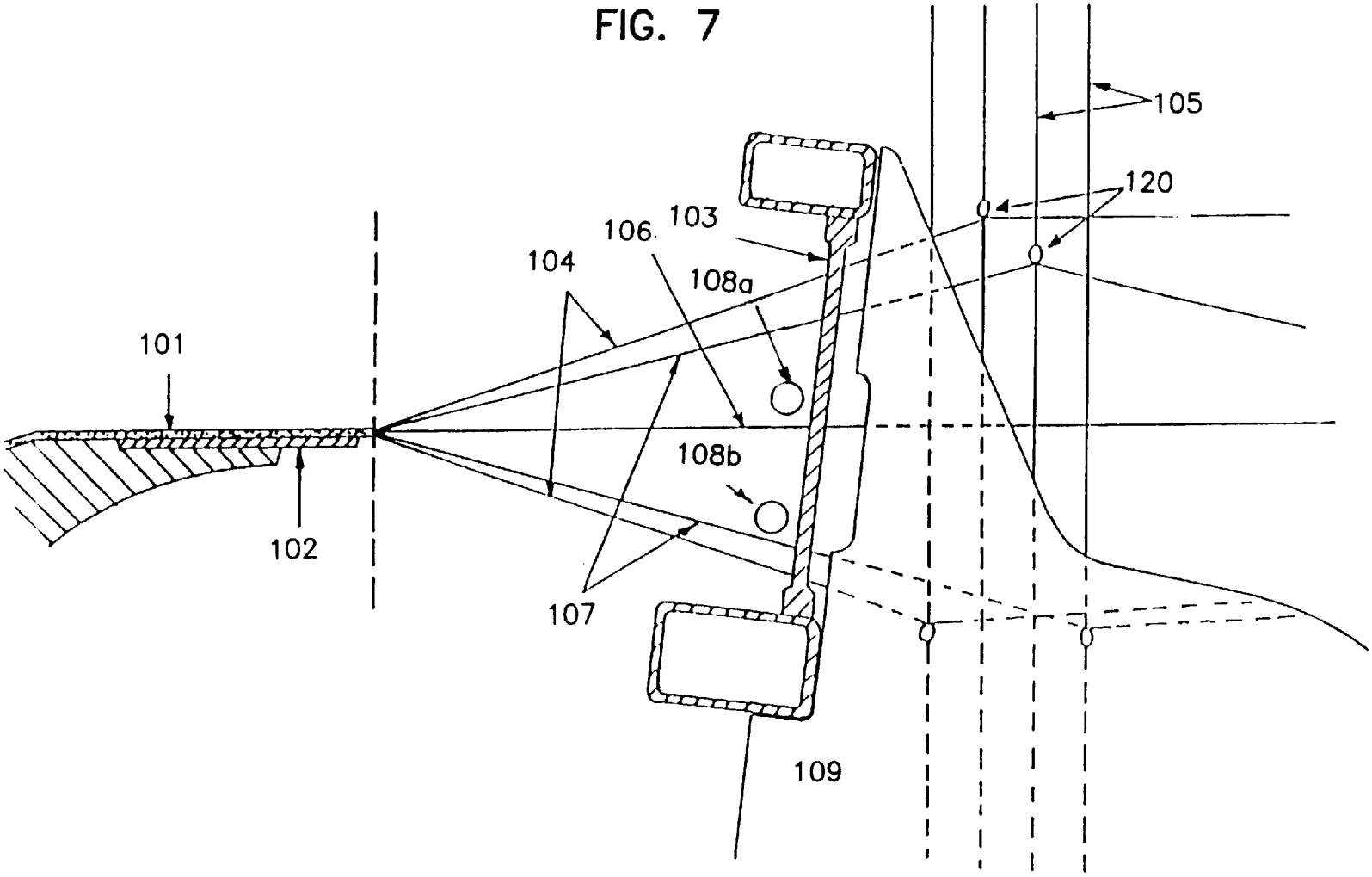
FIG. 7: Shown an alternative shedding detail according to a further embodiment of the invention.

In yet a further embodiment shown in FIG. 7, it is seen that two rapiers 108 and 108*b* are used to incorporate binding chains 107 either in the usual number of two per dent or any chosen reduction desirable to approximately the same extent as the pile warp thus providing for tighter binding of the weft fill.

It will be appreciated that the rapiers 108 each comprise a pair of center transferring rapier members working together to feed in, and to receive, the weft material respectively. Other types of weft insertion could however be used.

It is thus seen that the method and apparatus of the present invention achieve the insertion of a weft fill pile yarn material which is tightly retained to form part of the pile thus avoiding the hollow loops remaining from the Wilton wires. This is therefore much simpler and faster than using a typical Wilton wire loom and, due to the lesser number of machine components, is notably quieter and easier to operate and maintain. The resultant product due to its use of a weft fill material also has inherent advantages as mentioned above.

Where in the foregoing description reference has been made to specific components or integers of the invention having known equivalents then such equivalents are herein incorporated as if individually set forth.

Although this invention has been described by way of example and with reference to possible embodiments thereof it is to be understood that modifications or improvements may be made thereto without departing from the scope of the invention as defined in the appended claims.

I claim:

1. A method for the production of carpets comprising weaving together warp material including pile warp material, first and second weft materials and an additional weft material such that the additional weft material is held by and partially visible through the pile warp material and contributes to the pile of the carpet, and wherein said step of weaving together warp material comprises simultaneously weaving said first, second and additional weft materials.

2. A method as claimed in claim 1 including the step of forming a pair of warp yarns, comprising the pile warp material, into loops and positioning said additional weft material within said loops.

3. A method as claimed in claim 2 including providing binding chain warp yarns and; feeding said binding chain warps over and under said first and second weft materials and a stuffer warp yarn.

4. Apparatus for producing carpets comprising feeding means for feeding a first and second weft materials and warp material including pile warp material and binding chains and a stuffer warp material to a weaving means for their weaving together and wherein said feeding means includes means for feeding an additional weft material to said weaving means for weaving together with the warp material, said additional weft material to be held by and to be partially visible through the pile warp material and contributing to the pile of the carpet, and said feeding means feed the first, second and additional weft materials simultaneously.

5. An apparatus as claimed in claim 4 wherein said feeding means for said weft material comprises a plurality of rapiers respectively carrying one of said first and second weft materials and said additional weft material, said additional weft material being provided within loops formed by said pile warp material.

6. An apparatus as claimed in claim 4 wherein the feeding means for said first and second weft material and said additional weft material each comprises a respective rapier, the feeding means further comprising combining means for feeding the warp material over and under a stuffer warp material to combine with the first and second weft material and the additional weft material, said additional weft material being provided within loops formed by said pile warp material.

7. A carpet comprising a first and second weft material, and warp material including pile warp material woven together and an additional weft material that is held by and partially visible through the pile warp material and that contributes to the pile of the carpet.

8. A carpet as claimed in claim 7 wherein the pile warp material comprises pile warp yarns defining loops within which said additional weft material is positioned.

9. A carpet as claimed in claim 8 wherein said warp material includes a stuffer warp yarn and binding chains with said binding chains being positioned over and under said stuffer warp yarn.

10. A carpet as claimed in claim 8 wherein said warp material is provided over and under a stuffer warp yarn.

* * * * *